US006497614B2

(12) United States Patent
Kobayashi et al.

(10) Patent No.: US 6,497,614 B2
(45) Date of Patent: Dec. 24, 2002

(54) LENS PERIPHERY EDGE PROCESSING APPARATUS

(75) Inventors: Akio Kobayashi, Tokyo (JP); Yumi Takahashi, Tokyo (JP); Hiroshi Koizumi, Tokyo (JP); Kazuo Abe, Tokyo (JP); Makoto Taya, Tokyo (JP); Michiko Nakanishi, Tokyo (JP); Susumu Saito, Tokyo (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 71 days.

(21) Appl. No.: 09/824,365

(22) Filed: Apr. 2, 2001

(65) Prior Publication Data

US 2001/0031611 A1 Oct. 18, 2001

(30) Foreign Application Priority Data

Mar. 31, 2000 (JP) ..... 2000-099084

(51) Int. Cl.[7] ..... B24B 1/00

(52) U.S. Cl. ..... 451/43; 451/5; 451/8; 451/255; 451/256

(58) Field of Search ..... 451/43, 5, 8, 42, 451/255, 256, 10, 11, 240, 226, 228

(56) References Cited

U.S. PATENT DOCUMENTS

| | | | | | |
|---|---|---|---|---|---|
| 5,775,973 | A | * | 7/1998 | Watanabe | 451/5 |
| 5,895,314 | A | * | 4/1999 | Kitao et al. | 451/43 |
| 6,019,669 | A | * | 2/2000 | Kitao et al. | 451/43 |
| 6,220,929 | B1 | * | 4/2001 | Mizuno | 451/5 |
| 6,328,630 | B1 | * | 12/2001 | Jinbo et al. | 451/11 |
| 6,328,635 | B1 | * | 12/2001 | Suzuki et al. | 451/43 |

* cited by examiner

*Primary Examiner*—Lee Wilson
(74) *Attorney, Agent, or Firm*—Chapman and Cutler

(57) ABSTRACT

In a lens periphery edge processing apparatus comprising lens rotating shafts 16, 17 for putting and holding an objective lens therebetween, a carriage 15 rotatable around a pivot, and a grindstone rotating shaft 9 provided with a grindstone 5 for grinding the objective lens L, the lens rotating shaft 17 is provided with a reference globe 70 having a predetermined radius.

5 Claims, 6 Drawing Sheets

LENS PERIPHERY EDGE PROCESSING APPARATUS

BACKGROUND OF THE INVENTION

1. Field of the Invention

The present invention relates to a lens periphery edge processing apparatus for grinding a periphery edge of an objective lens to a lens shape such as a lens frame shape or mold shape of eyeglasses.

2. Description of the Prior Art

In conventional lens periphery edge processing apparatus, a reference globe is put and held between a lens rotating shafts instead of an objective lens, a carriage supporting the lens rotating shafts is lowered so that the reference globe is contacted with a grindstone, the location of the carriage at this time is detected, corrected data of the inter-shaft distance between a grindstone rotating shaft and the lens rotating shafts are obtained on the basis of the detected location data, and then, the reference globe is detached and the objective lens is put and held between the lens rotating shafts, the inter-shaft distance is corrected on the basis of said corrected data, and the vertical movement of the carriage is controlled, thereby the objective lens is ground.

However, in the above-mentioned conventional lens periphery edge processing apparatus, in case where an initial set is performed whenever the objective lens is processed, the corrected data is obtained by inserting the reference globe to the lens rotating shafts, and then, the reference globe is detached, and the objective lens should be put and held between the lens rotating shafts. Accordingly, there are problems that the operation for inserting or detaching the reference globe is complicated, and considerable time is required.

SUMMARY OF THE INVENTION

The object of the present invention is to provide a lens periphery edge processing apparatus in which the operation or inserting or detaching the reference globe does not need to be inserted or detached.

According to the present invention, there is provided the lens periphery edge processing apparatus comprising lens rotating shafts for putting and holding an objective lens therebetween, a carriage rotatable around a pivot, and a grindstone rotating shaft provided with a grindstone for grinding the objective lens, wherein a reference globe having a predetermined radius is fixed to one of said rotating shafts.

BRIEF DESCRIPTION OF THE DRAWINGS

FIG. 5(*b*) is a diagram of a part of finishing sensor;

FIG. 5(*c*) is a diagram showing the operation of the finishing sensor;

FIG. 5(*d*) is a diagram showing the operation of the finishing sensor; and

DETAILED DESCRIPTION OF THE EMBODIMENT

Hereinafter, the embodiments of the present invention will be explained with reference to the accompanying drawings.

Figure 1:
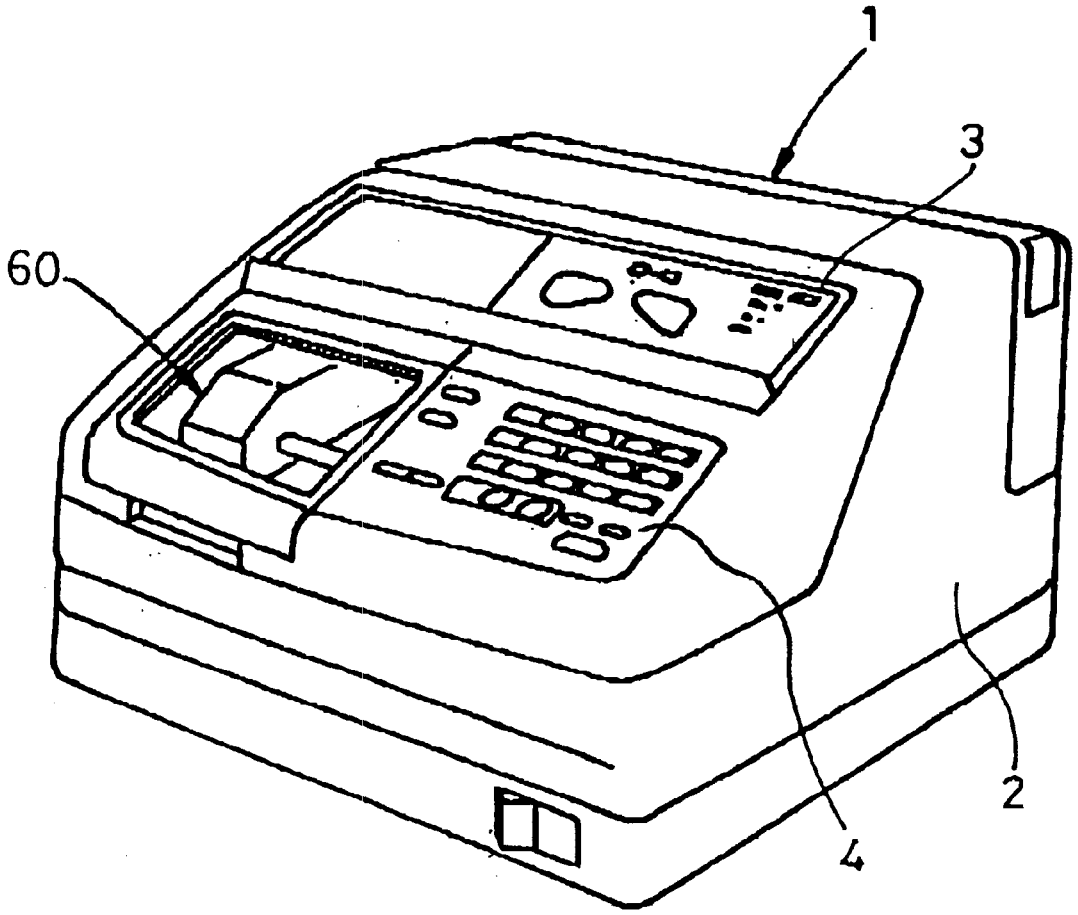
FIG. 1 is a perspective view showing the appearance of a lens periphery edge processing apparatus (lens grinding machine) according to the present invention.
Figure 2:
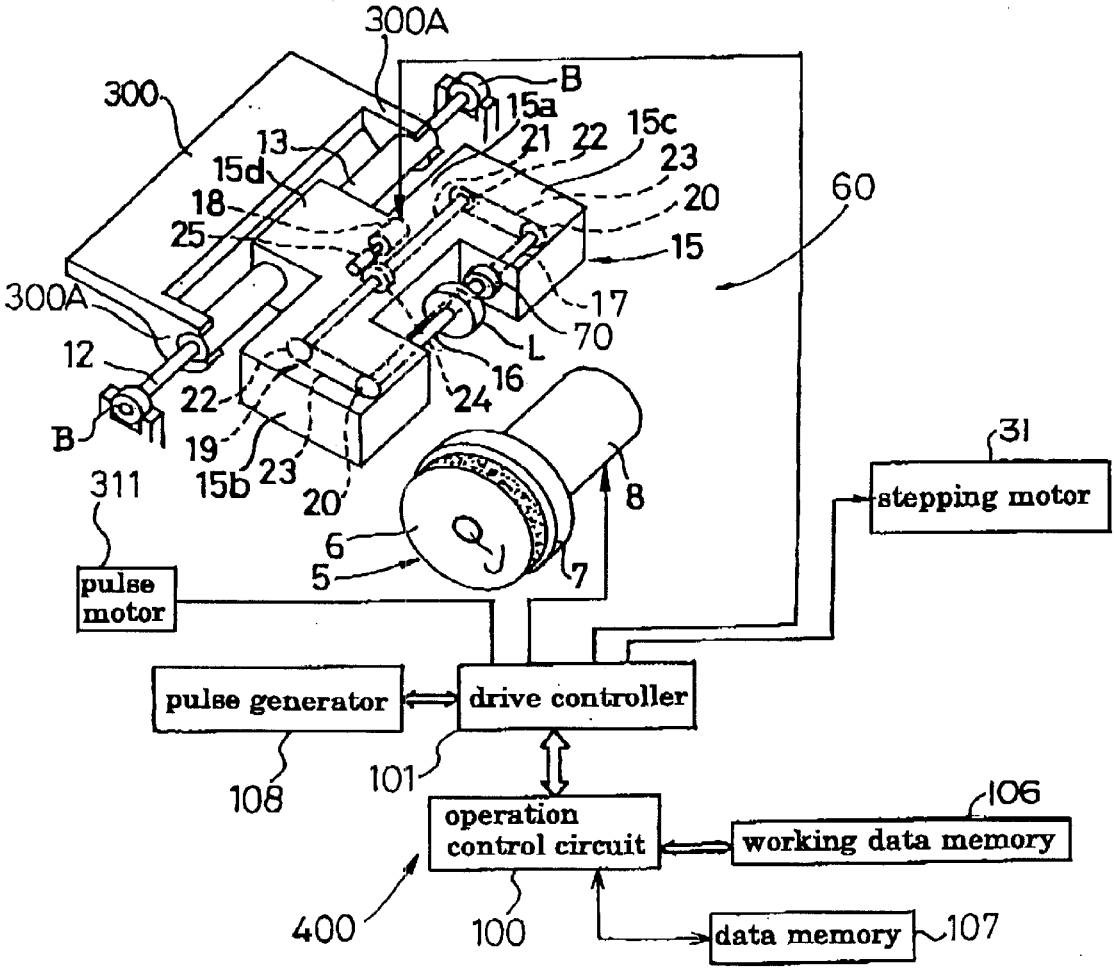
FIG. 2 is a diagram showing the composition of the lens periphery edge processing apparatus in FIG. 1.

As shown in FIGS. 1 and 2, the lens periphery edge processing apparatus 1 comprises a body 2, and a grinding portion 60 provided in the body 2.

In the slanted surface of the body 2, a liquid crystal display portion 3 and a keyboard portion 4 are provided.

The grinding portion 60 has a grindstone 5 rotated by a motor 8, a carriage 15 rotatable around a supporting shaft 12, and a pair of lens rotating shafts 16, 17 supported by the carriage 15. The grindstone 5 comprises a rough grindstone 6 and a V-shaped groove grindstone 7, and is rotated around an axis of grindstone rotating shaft J.

The carriage 15 has a carriage body 15*a,* arm portions 15*b,* 15*c* which are integrally provided in the both sides of the carriage body 15*a* toward the front side and are parallel with each other, and a protrusion portion 15*d* protruded toward the rear side in the center of the rear edge of the carriage body 15*a*. The protrusion 15*d* is fixed with a case shaft 13 penetrating left and right. A supporting shaft 12 is rotatably accommodated in the case shaft 13, and the carriage 15 can be rotated around the supporting shaft 12.

The lens rotating shaft 16 is rotatably supported by the arm portion 15*b* of the carriage 15, and the lens rotating shaft 17 arranged coaxially with the lens rotating shaft 16 is supported by the arm portion 15*c* of the carriage 15 such that the lens rotating shaft 17 can be rotated and can adjustably reciprocate with respect to the lens rotating shaft 16, and the objective lens L is inserted between the opposite ends (between one end) of the lens rotating shafts 16, 17. Also, a circular reference globe (reference correcting member) 70 is fixed to the lens rotating shaft 17. The diameter of the reference globe 70 is set to be smaller than the minimum diameter of the processed objective lens L.

The lens rotating shafts 16, 17 are rotated by a shaft rotation driving mechanism (shaft rotation driving means). The shaft rotation driving mechanism has a pulse motor 18 fixed in the carriage body 15*a,* and a power transmitting mechanism (power transmitting means) 19 for transmitting the rotation of the pulse motor 18 to the lens rotating shafts 16, 17.

As shown in FIG. 2, the power transmitting mechanism 19 consists of timing pulleys 20, 20 attached to the lens rotating shafts 16, 17 respectively, a rotary shaft 21 rotatably supported by the carriage body 15*a,* timing pulleys 22, 22 fixed to the both ends of the rotary shaft 21 respectively, a timing belt 23 laid on the timing pulleys 20, 22, a gear 24 fixed to the central location of the rotary shaft 21, and a pinion 25 for output of the pulse motor 18.

Figure 3:
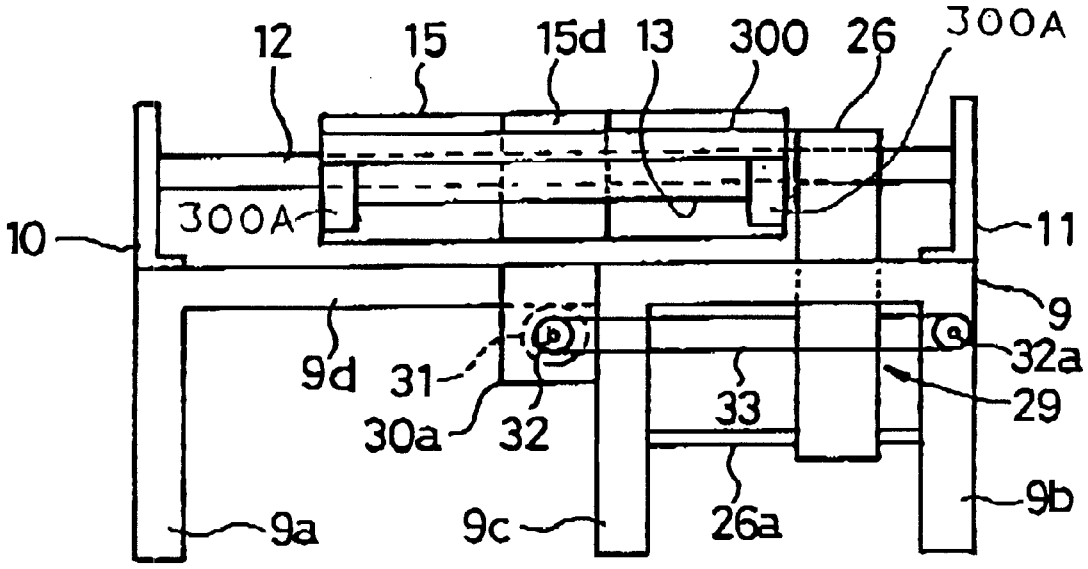
FIG. 3 is a schematic rear view of the carriage attaching portion shown in FIG. 1.
Figure 4:
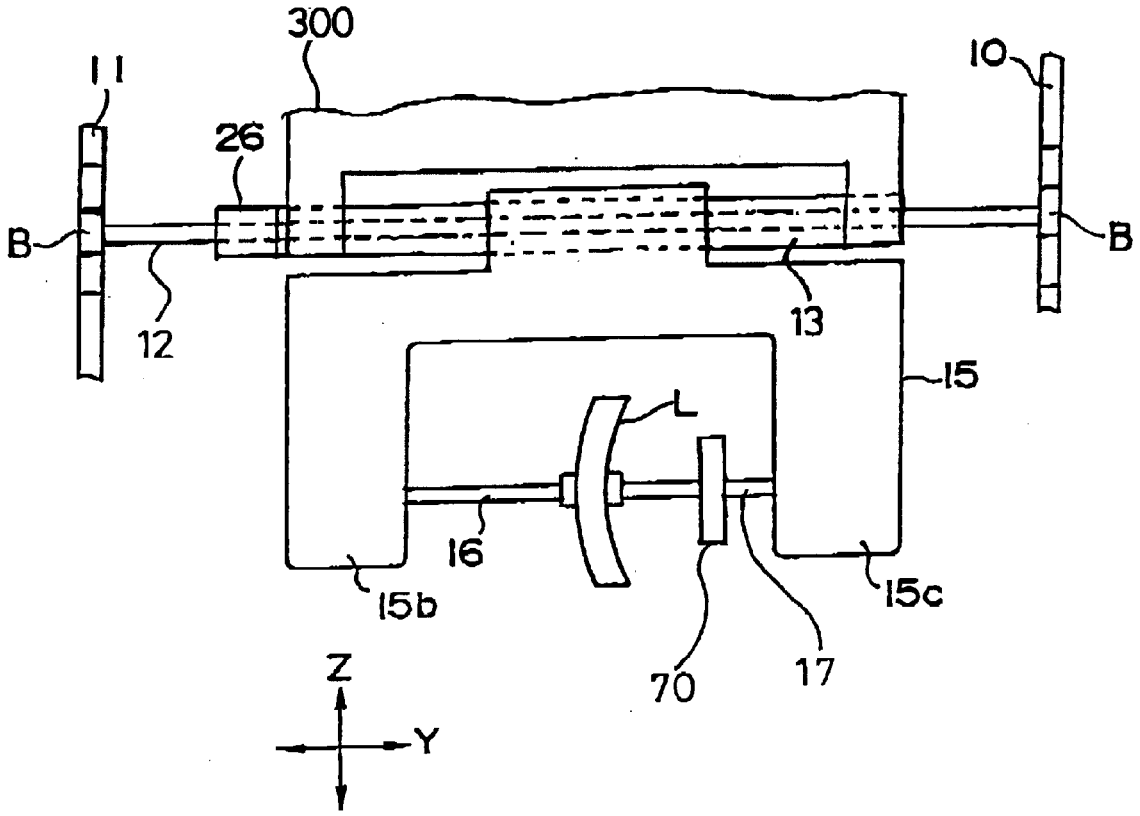
FIG. 4 is a schematic plan diagram showing the objective lens put and held between the lens rotating shafts and the carriage.
Figure 5A:
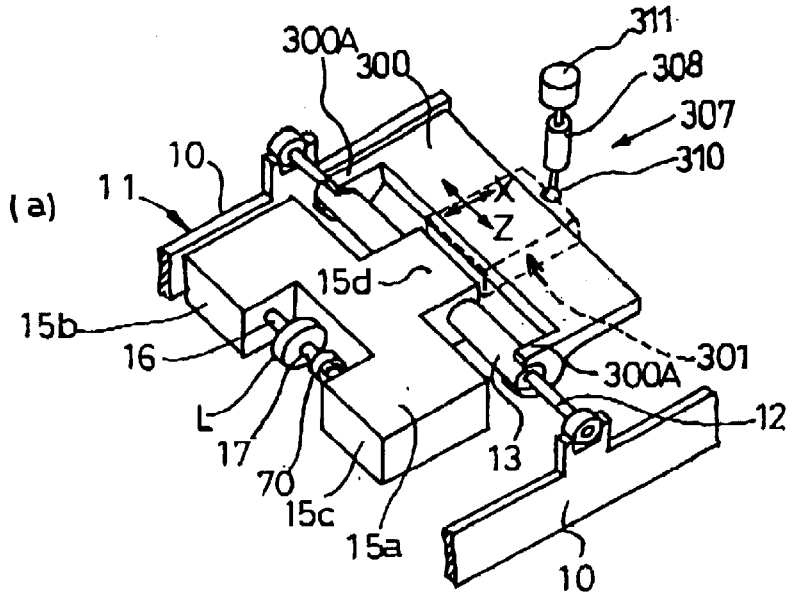
FIG. 5(*a*) is a diagram showing the carriage.
Figure 5B:
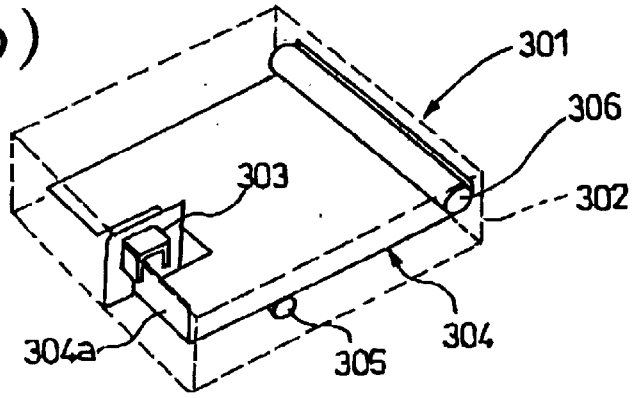
Figure 5C:
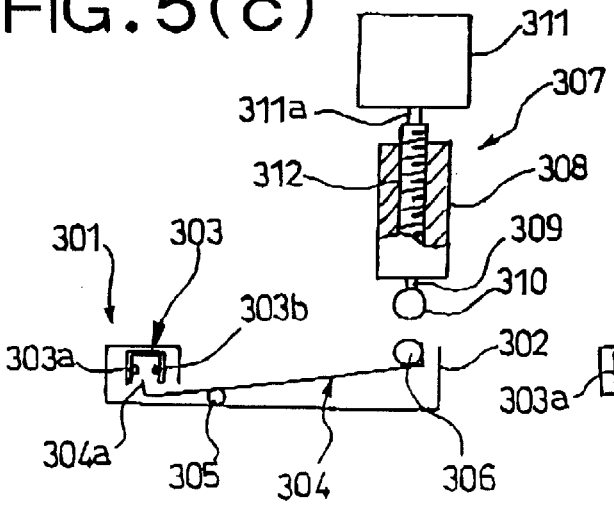
Figure 5D:
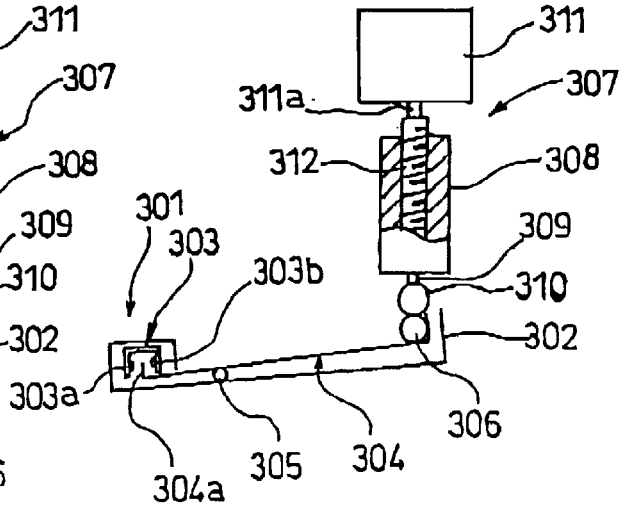

As shown in FIGS. 3 and 4, the upper end of the supporting arm 26 is supported by the supporting shaft 12 (in FIG. 1, now shown) to be horizontally movable. Also, the upper end of the supporting arm 28 is connected to the case shaft 13, and the case shaft 13 can be moved along the supporting shaft 12. A supporting pedestal 9 for supporting the carriage is fixed in the body 2, and the both ends of a guide shaft 26*a* parallel with the supporting shaft 12 are fixed to a leg portions 9*b,* 9*c* of the supporting pedestal 9. The guide shaft 26*a* penetrates the lower end of the supporting arm 26 and guides the supporting arm 26 to be horizontally movable.

<Carriage horizontal moving means>

As shown in FIG. 3, the carriage 15 is provided in a carriage horizontal moving means 29 to be horizontally movable.

As shown in FIG. 3, the carriage horizontal moving means 29 has an attaching plate 30*a* fixed to the leg portion 9*c* and an attaching plate portion 9*d,* a stepping motor 31 fixed to the front surface of the attaching plate 30*a,* a pulley 32 which penetrates the attaching plate 30*a* of the stepping motor 31 and is fixed to an output shaft 31*a* protruded from the rear surface side, a pulley 32*a* rotatably attached to the rear surface of the leg portion 9*b,* and a wire 33 which is wound on the pulleys 32, 32*a* and the both ends thereof are fixed to the supporting arm 26.

Brackets 10, 11 for attaching the shaft are protruded from the supporting pedestal 9. A bearing B inserted into the left and right ends of the supporting shaft (swing shaft, that is, pivot) 12 is supported by the brackets 10, 11.

Also, the both ends of the case shaft 13 is fixed to protrusions 300A, 300A of a plate-shaped swing arm 300, and the upper side of the rear portion of the swing arm 300 is provided with a carriage elevating means 307 as shown in FIG. 5.

<Carriage elevating means>

The carriage elevating means 307 has a pulse motor 311 supported in the body 2 through the bracket (not shown), a male screw 312 integrally provided coaxially with an output shaft 311*a* of the pulse motor 311, a female screw case 308 screwed to the male screw 312 to be vertically movable, and a spherical pressing member 310 integrally provided to the lower end of the female screw case 308. And, the female screw case 308 is supported in the body 2 through the bracket (not shown) such that the female screw case cannot be rotated around the axis and can be vertically moved. The female screw case 308 is vertically moved by the rotation of the output shaft 311*a* of the pulse motor 311.

The lower surface of the female screw case 308 is contacted with the upper surface of the rear portion of the swing arm 300, and the swing arm 300 is rotated around the supporting shaft 12 by vertically moving the female screw case 308. The carriage 15 is rotated around the supporting shaft 12 integrally with the swing arm 300 by the rotation of the swing arm 300. Namely, the carriage 15 is vertically moved by the vertical movement of the female screw case 308.

The lower surface of the swing arm 300 is arranged with a finishing sensor 301 as shown in FIG. 5.

<Finishing sensor>

The finishing sensor 301 has a case 302 to the lower surface of the swing arm 300, a photo-interrupter (detecting sensor) 303 arranged in one end of the case 302, a light shield plate 304, and a supporting shaft 305 which supports the middle portion of the light shield plate 304 to support the both ends of the light shield plate 304 to be vertically movable in the seesaw manner.

As shown in FIGS. 5(*c*) and 5(*d*), the photo-interrupter 303 has a light emitting device (light emitting means) 303*a* and a light receiving device (light receiving means) 303*b*. Also, one end of the light shield plate 304 has a fixed axial bearing member 306, and the other end thereof has a light shield portion 304*a* bent to the upper side. Also, for example, since there is provided the composition that the middle portion of the light shield plate 304 is fixed with the supporting shaft 305, and the supporting shaft 305 is rotatably supported by the case 302, the light shield plate 304 is supported by the case 302 to be vertically movable in the seesaw manner.

The finishing sensor 301 is provided in the upper side of the axial bearing member 36, and functions as a grinding amount setting means for setting the grinding amount of the objective lens L.

In the finishing sensor 301, when the finishing processing of the lens L is performed, the lens L is ground by a predetermined amount, and thus, when the lens L is contacted with the grindstone 7, the swing arm 300 is rotated by the predetermined amount, thereby the rear portion of the swing arm 300 is displaced (raised) by the predetermined amount. In the displacement, the axial bearing member 306 of the finishing sensor 301 is contacted with the spherical pressing member 310, and by raising the rear end of the swing arm 300, the spherical bearing member 306 of the light shield plate 304 is lowered around the supporting shaft 305, and together with the lowering, the light shield portion 304*a* is raised to be inserted between the light emitting device 303*a* and the light receiving device 303*b* of the photo-interrupter 303, thereby the light directing from the light emitting device 303*a* to the light receiving device 303*b* is intercepted.

Namely, when the finishing processing of the lens L is performed, the light shield portion 304*a* is set to intercept the light from the light emitting device 303*a* to the light receiving device 303*b,* thereby the finishing processing of the lens L is detected. Also, the finishing sensor 301 is turned OFF when the light shield portion 304*a* intercepts the light from the light emitting device 303*a* to the light receiving device 303*b,* and is turned ON when the light shield portion 304*a* does not intercept the light.

<Control device>

The body 2 is provided therein with a control device 400, and the control device 400 comprises an operation control circuit 100, a drive controller 101 for driving and controlling the motors 8, 18, 31, 311, etc., a processing data memory 106 storing the processing data for processing the lens L, a data memory 107 storing the corrected data for correcting the distance between the lens rotating shafts 16, 17 and the grindstone rotating shaft 9, and a pulse generating circuit 108 generating the pulse for driving each motor 8, 18, 31, 311.

<Operation>

Figure 6:
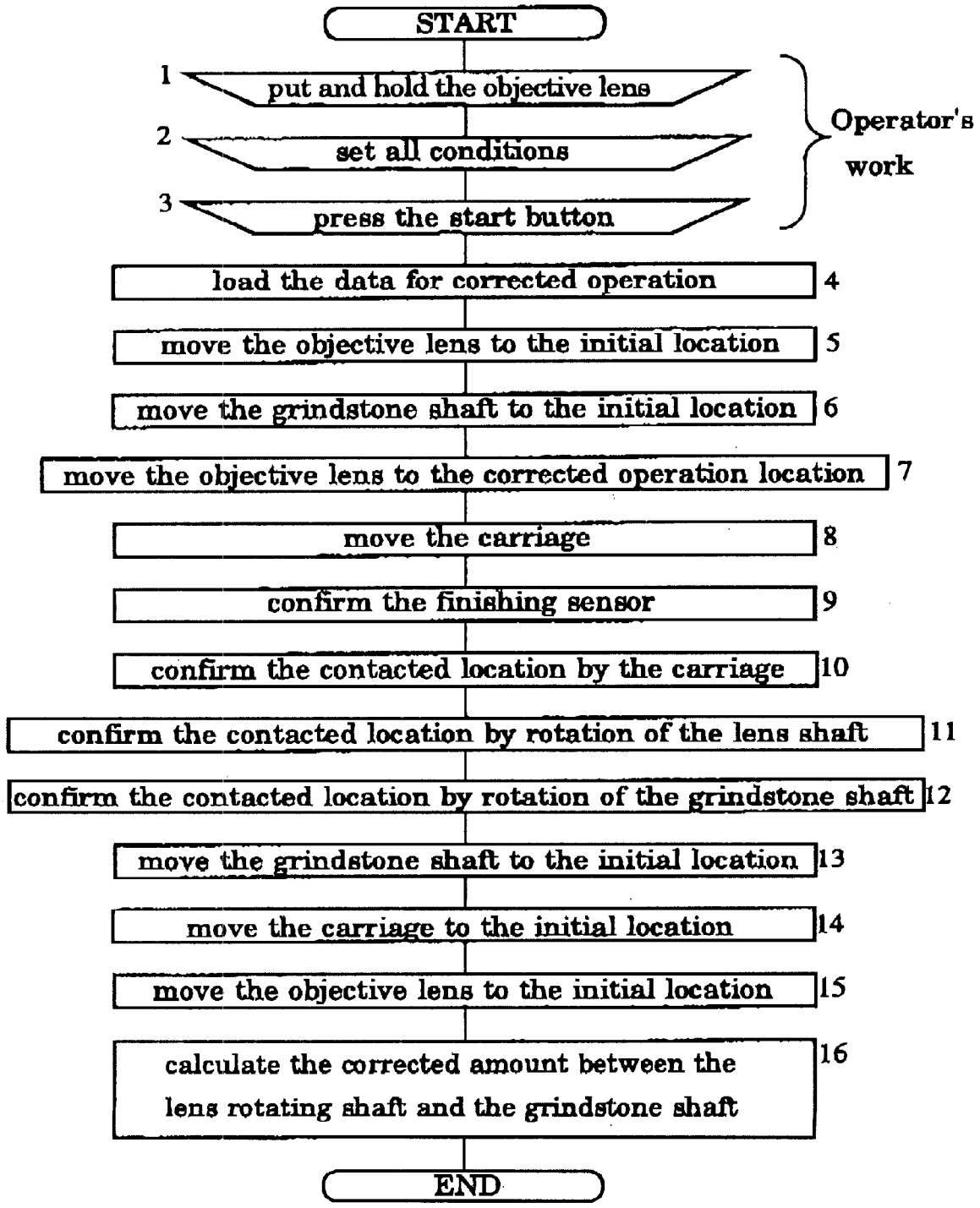
FIG. 6 is a flow chart showing the main operation of the lens periphery edge processing apparatus.

Next, the operation of the lens periphery edge processing apparatus having the above-mentioned composition will be described with reference to the flowchart shown in FIG. 6.

In the step 1, as operator inserts the objective lens L to the rotating shafts 16, 17 of the carriage 15. At this time, since the center of the absorbing plank absorbed into the objective lens L coincides with the optical center of the objective lens L, the optical center of the objective lens L coincides with the lens rotating shafts 16, 17, and thus, the objective lens L is put and held between the rotating shafts 16, 17.

In the step 2, the operator inputs all conditions such as a PD value of the eyeglass wearer, the amount U that the optical center of the lens L is approached to the upper side, and lens materials by key operation of the keyboard portion 4 of the body 2, and presses a start button (the step 3).

In the step 4, the operation control circuit 100 reads the corrected amount that is corrected previously (initial correction) from the data memory 107. And the operation control circuit 100 drives and controls the pulse motor 18 through the drive controller 101, and rotates the lens rotating shafts 16, 17 through the power transmitting mechanism 19 by the drive of the pulse motor 18. The objective lens L is rotated and moved to the initial processing location by the rotation of the lens rotating shafts 16, 17 (the step 5).

In the step 6, the operation control circuit 100 drives and controls the pulse motor 8 through the drive controller 101, and moves the grindstone rotating shaft 9 to the initial processing location (starting point).

In the step 7, the operation control circuit 100 drives and controls the stepping motor 31 through the drive controller 101, and moves the carriage 15 to the left side in FIG. 4 to be located at the position where the reference globe 70 can be contacted with the rough grindstone 6. And, the operation control circuit 100 drives and controls the pulse motor 311 through the drive controller 101 and lowers the carriage 15 (the step 8). At this time, since the carriage 15 is lowered at the state shown in FIG. 5(*d*), the finishing sensor 301 becomes turned OFF.

In the step 9, the state of the finishing sensor 301 is confirmed, and the carriage 15 is lowered until the finishing sensor 301 becomes turned ON. The operation control circuit 100 stops lowering the carriage 15 when the finishing sensor 301 is turned ON. That is, when the reference globe 70 is contacted with the rough grindstone 6, the lowering of the carriage 15 is stopped.

In the step 10, the operation control circuit 100 drives and controls the pulse motor 311 through the drive controller 101, and raises the carriage 15. After it is confirmed that the finishing sensor 301 is in the state of OFF, the operation control circuit 100 allows the data memory 107 to store the pulse number of the pulse motor 311 required for raising the carriage 15. Then, the operation control circuit 100 drives and controls the pulse motor 311 through the drive controller 101, and lowers the carriage 15. When the finishing sensor 301 is turned ON, the lowering of the carriage 15 is stopped, and the pulse number required for lowering, the rotated angle of the grindstone rotating shaft 9 at this time, and the rotated angle of the lens rotating shafts 16, 17 are stored in the data memory 107.

In the step 11, the operation control circuit 100 controls the drive of the pulse motor 311 through the drive controller 101, and raises the carriage 15 such that the contact between the reference globe 70 and the rough grindstone 6 is released. And, after it is confirmed that the finishing sensor 301 is in the state of OFF, and the pulse number of the pulse motor 311 required for raising the carriage 15 is stored in the data memory 107. And then, the operation control circuit 100 drives and controls the pulse motor 18 through the drive controller 101, and rotates the lens rotating shafts 16, 17 at certain angle. That is, the reference globe 70 is rotated at the certain angle. After the rotation is finished, the operation control circuit 100 controls the pulse motor 311 through the drive controller 101, and lowers the carriage 15. And, the states ON/OFF of the finishing sensor 301 are confirmed, and when the finishing sensor 301 is in the state of ON, the lowering of the carriage 15 is stopped at this location.

And, the above-mentioned operations are repeated until the rotated angle of the reference globe 70 becomes 360 degree, and at the same time, the rotated angle of the grindstone rotating shaft 9, the rotated angle of the lens rotating shafts 16, 17, and the pulse number required for vertically moving the carriage 15 are stored in the data memory 107 (the step 11).

In the step 12, the operation control circuit drives and controls the pulse motor 311 through the drive controller 101, and raises the carriage 15 such that the contact between the reference globe 70 and the rough grindstone 6 is released. And, it is confirmed that the finishing sensor 301 is in the state of OFF, and the pulse number of the pulse motor 311 required for raising the carriage 15 is stored in the data memory 107. And then, the operation control circuit 100 drives and conntrols the pulse motor 8 through the drive controller 101, and rotates the rough grindstone 6 at certain angle. After the rotation is finished, the operation control circuit 100 drives and controls the pulse motor 311 through the drive controller 101, and lowers the carriage 15. And, the states ON/OFF of the finishing sensor 301 are confirmed, and when the finishing sensor 301 is in the state ON, the lowering of the carriage 15 is stopped at this location.

And, the above-mentioned operations are repeated until the rotated angle of the grindstone rotating shaft 9 becomes 360 degree, and at the same time, the rotated angle of the grindstone rotating shaft 9, the rotated angle of the lens rotating shafts 16, 17, and the pulse number required for vertically moving the carriage 15 are stored in the data memory 107 (the step 12).

In the step 13, the operation control circuit 100 drives and controls the pulse motor 8 through the drive controller 101, and moves the grindstone rotating shaft 9 to the starting point.

In the step 14, the operation control circuit 100 drives and controls the pulse motor 311 through the drive controller 101, lowers the swing arm 300, and moves (raises) the carriage 15 to the initial location.

In the step 15, the operation control 100 drives and controls the pulse motor 18 through the drive controller 101, rotates the lens rotating shafts 16, 17, and rotates and moves the objective lens L to the initial processing data location.

In the step 16, the corrected amount of the inter-shaft distance between the lens rotating shafts 16, 17 and the grindstone rotating shaft 9 is calculated from the data stored in the data memory 107 in the steps 11 and 12 and the corrected amount used in the step 4. The corrected amount is stored in the data memory 107, and the corrected amount is updated.

As mentioned in the above, since the reference globe 70 is fixed to the lens rotating shaft 17, in case where the inter-shaft distance is corrected whenever the objective lens L is processed, the fitting or removing of the reference globe is not needed, thereby the processing operation can be quickly performed.

Also, since the grindstone rotating shaft 9 is rotated every certain angle so that the corrected amount of the inter-shaft distance is obtained, the eccentric amount of the grindstone rotating shaft 9 can be known, and the eccentric amount is applied, thereby the lens processing can be accomplished without an error.

What is claimed is:

1. An objective lens periphery edge processing apparatus comprising lens rotating shafts for interposing and holding the objective lens therebetween, the shafts being supported by a pivotably rotatable carriage, and a grindstone positioned on a grindstone shaft for grinding the edge of the objective lens, wherein a reference correcting member having a predetermined radius is mounted on one of said rotating shafts.

2. The lens periphery edge processing apparatus according to claim 1, wherein said lens rotating shafts and said grindstone rotating shaft are relatively movable so that the reference correcting member mounted on one of said rotating shafts may come into contact with said grindstone in order to measure an eccentric amount of said grindstone rotating shaft.

3. The lens periphery edge processing apparatus according to claim 2, wherein the eccentric amount of said grindstone rotating shaft is measured by rotating said grindstone rotating shaft and contacting said reference correcting member every time the grindstone is being turned on a predetermined angle.

4. The lens periphery edge processing apparatus according to claim 2, further comprising a finishing sensor for detecting the contact between said reference correcting member and said grindstone, and detecting finishing of the objective lens.

5. The lens periphery edge processing apparatus according to claim 3, further comprising a finishing sensor for detecting the contact between said reference correcting member and said grindstone, and detecting finishing of the objective lens.

* * * * *